US005421236A

United States Patent [19]

Sanger

[11] Patent Number: 5,421,236

[45] Date of Patent: Jun. 6, 1995

[54] METRONOMIC APPARATUS AND MIDI SEQUENCE CONTROLLER HAVING ADJUSTABLE TIME DIFFERENCE BETWEEN A GIVEN BEAT TIMING SIGNAL AND THE OUTPUT BEAT SIGNAL

[76] Inventor: David Sanger, Curragh House, East Haugh, Pitlochry, Scotland, PH16 5J8

[21] Appl. No.: 174,218

[22] Filed: Dec. 28, 1993

Related U.S. Application Data

[63] Continuation of Ser. No. 854,992, Apr. 30, 1992, abandoned.

[30] Foreign Application Priority Data

Oct. 31, 1989 [GB] United Kingdom ..... 8924453

[51] Int. Cl.[6] ..... G10G 1/00

[52] U.S. Cl. ..... 84/484; 84/464 R; 84/645

[58] Field of Search ..... 84/464 R, 484, 470 R, 84/645

[56] References Cited

U.S. PATENT DOCUMENTS

| | | | |
|---|---|---|---|
| 4,070,944 | 1/1978 | Castillo | 84/484 |
| 4,141,273 | 2/1979 | Austin . | |
| 4,193,257 | 3/1980 | Watkins | 84/484 |
| 4,218,874 | 8/1980 | Ishida et al. | 84/484 |
| 4,442,752 | 4/1984 | Tsuchiya | 84/484 |
| 4,649,794 | 3/1987 | George | 84/484 |
| 4,694,724 | 9/1987 | Kikumoto et al. . | |
| 4,919,030 | 4/1990 | Perron | 84/484 X |
| 4,982,642 | 1/1991 | Nishikawa et al. | 84/484 |

FOREIGN PATENT DOCUMENTS 8804710 10/1988 Germany .

2217483 10/1989 United Kingdom .

*Primary Examiner*—William M. Shoop, Jr.

*Assistant Examiner*—Jeffrey W. Donels

*Attorney, Agent, or Firm*—Knobbe, Martens Olson & Bear

[57] ABSTRACT

This invention relates to a metronomic apparatus and MIDI sequence controller. The metronomic apparatus comprises a visual display which indicates not only the beat of a piece of music but also gives an indication of the occurence of preset between beat timing signals. The user who takes his cue from the between beat timing signals can vary his playing in advance of or behind the beat. The MIDI sequence controller comprises an easily triggerable switch device which allows a musician, during a performance, to edge a MIDI sequencer forward or backward to resynchronize with the playing of musicians who have fallen out of synchronization.

11 Claims, 2 Drawing Sheets

METRONOMIC APPARATUS AND MIDI SEQUENCE CONTROLLER HAVING ADJUSTABLE TIME DIFFERENCE BETWEEN A GIVEN BEAT TIMING SIGNAL AND THE OUTPUT BEAT SIGNAL

This application is a continuation of application Ser. No. 07/854,992, filed Apr. 30, 1992, now abandoned.

FIELD OF THE INVENTION

This invention relates in a first aspect to metronomic apparatus and in particular to metronomic apparatus giving a visual indication of the tempo of a piece of music. In addition, a second aspect of this invention relates to a MIDI (Musical Instrument Digital Interface) sequence controller.

DESCRIPTION OF THE PRIOR ART

Metronomic apparatus have hitherto been limited to providing an indication of the beat of a piece of music. One of the subtleties of musicianship is, however, to play not exactly on the beat but slightly off it. This is desirable because it can dramatically alter the subjective quality of the music; for example, in reggae music the rhythm guitar plays significantly behind the beat, contributing to the relaxed feel of such music.

Learning to play in advance of or behind the beat is a skill which is not readily acquired, not least because there have hitherto not been available any devices which clearly indicate to the novice the point in time offset from the beat upon which they should try and base their playing. Even to those with a developed sense of tempo, playing in such a manner is sometimes extremely challenging, for instance when there are any sorts of distractions. There is therefore a need for a device which can present to the musician clear visual cues from which the musician can base his playing of music either in advance of or behind the beat.

Referring to the second aspect of the invention, MIDI sequencers allow keystrokes played, for example, on a synthesiser to be recorded digitally in the form of a so called sequence. The sequence can be played back through MIDI equiped instruments as music. Any portion of MIDI sequence output from the sequencer at any given instant to connected instruments determines the sounds that those instruments will make. The required portion of sequence can be arrived at in much the same way that other forms of pre-recorded audio information can be accessed. It can be reached by playback at normal run speed, or can be reached by fast forwarding or reversing to a later or earlier portion of stored signal. A typical prior an MIDI sequencer comprises a personal computer programmed with MIDI sequence software allowing the computer to record, manipulate and output MIDI sequence. With such a system, skipping from a portion of a sequence to a later pan of of that sequence is achieved via the screen interface. For example, such a system could provide a screen display of several bars of music which scrolls forward as the sequence is worked through. A movable cursor line may indicate those notes being played at any given moment. Should the user move the cursor to a different pan of the score, then the intervening notes would be skipped and the sequence recommenced at the different pan. Generally, moving the cursor is achieved by using a mouse device or the cursor control keys of the keyboard. A disadvantage of this approach is particularly apparent when such a system is used during performance. If the musicians and the MIDI sequence get out of synchronisation then it is difficult to to use a mouse to edge the sequence forwards or backwards until there is resynchronisation. It is extremely difficult for a musician to do this whilst continuing to play an instrument. Consequently, in practice musicians do not even consider trying to edge the sequence into synchronisation, instead regarding the MIDI sequence as a constraint that has to be followed. This may be a fetter to their musicianship and detract from the quality of the musical performance.

OBJECTS OF THE INVENTION

It is an object of the first aspect of the invention to provide a metronomic apparatus which overcomes the limitations of prior an metronomes.

It is an object of the second aspect of the invention to provide a MIDI sequence controller that allows a MIDI sequence to be controlled during performance in a way previously impossible.

SUMMARY OF THE INVENTION

In accordance with the first aspect of the invention, a metronomic apparatus to assist a musician to play in accompaniment to music of a given beat comprises:

beat signal means providing a beat signal having a period equal to or being a fixed fraction of the given beat;

timing means providing between beat timing signals arranged to occur a predetermined time in advance of or before each beat signal;

visual display means providing a display in dependence upon the between beat timing signals.

A musician using such a device can take his cue from the display associated with the between beat timing signals and therefore play not exactly on the beat but offset from it. The timing means is controlled by the musician such that he or she can vary precisely the degree which the between beat timing signals are in advance of or behind the beat.

Preferably, the visual display means also provides a display in dependence on the beat signal. Conveniently, the visual display means comprises a beat light which is triggerable only by each beat signal, thus giving a clear indication of the tempo of the music, and a series of between beat lights, which lights are each separately triggerable by a different between beat timing signal, there being a number of such between beat timing signals between each beat so that each light is sequentially triggered, culminating in the triggering of the beat light.

The visual display means may comprise two limbs, each limb having a beat light and a series of between beat lights. In such an embodiment, the lights on one limb are sequentially triggered during a given beat period and the lights on the other limb triggered on the next period. It will be appreciated that the appearance of the device in use is to some extent reminiscent of the movement of a conductor's baton. If the lights on a limb are arranged in a straight line then it is preferable that the beat light is positioned at one end with the between beat lights leading to the other end. When the time which elapses between adjacent between beat lights triggering is constant, then it is preferable that the spacing between adjacent lights decreases towards the said other end. With the appropriate choice of spacing, the apparent tipple of light across the limb has a linear simple harmonic form, which is desirable since it is a form common in nature and thus one which most musicians can readily tune in to and thus anticipate.

The apparatus may aim comprise a MIDI (Musical Instrument Digital Interface) input which allows a computer, such as a sequencer, to input the beat signal. This feature is useful since it allows recorded music which incorporates a MIDI signal to be played back for a musician to accompany, with the musician using the present invention to assist him or her to play in advance of or behind the beat.

In accordance with the second aspect of the invention, a MIDI sequencer controller comprises:

an output signal generator for generating an output signal operable to control a MIDI sequence;

an input control device trigerrable by a user to cause the output signal generator to supply the output signal wherein the input control device comprises a switch which when in an untriggered position does not cause the output signal generator to supply the output signal and when in triggered position does cause the output signal generator to supply the output signal to cause the MIDI sequence to skip at a predetermined rate or amount and in a predetermined direction.

By providing a switch device which can be easily operated even by a musician during performance and giving the switch the control function of edging the sequence forwards or backwards, the prior an deficiencies are overcome.

Conveniently, the switch can be a simple on-off switch such that there is a single triggered position or it can have a number of 'on' positions providing a scale of triggered positions. The latter is particularly advantageous as it allows the MIDI sequence to be edged forward at different rates or amounts in dependence on the particular triggered position selected. The switch may be a pressure sensitive switch, whereby the different 'on' positions correspond to different applied pressures. In one embodiment, the input control device is a foot pedal type device. Preferably,the output signal is operable to cause a MIDI clock controlling the sequence to skip a predetermined number of cycles or to skip at a predetermined rate. This is a particularly convenient way of realising the control function.

BRIEF DESCRIPTION OF THE DRAWINGS

The present invention will now be described with reference to the accompanying drawings in which.

DETAILED DESCRIPTION

Figure 1:
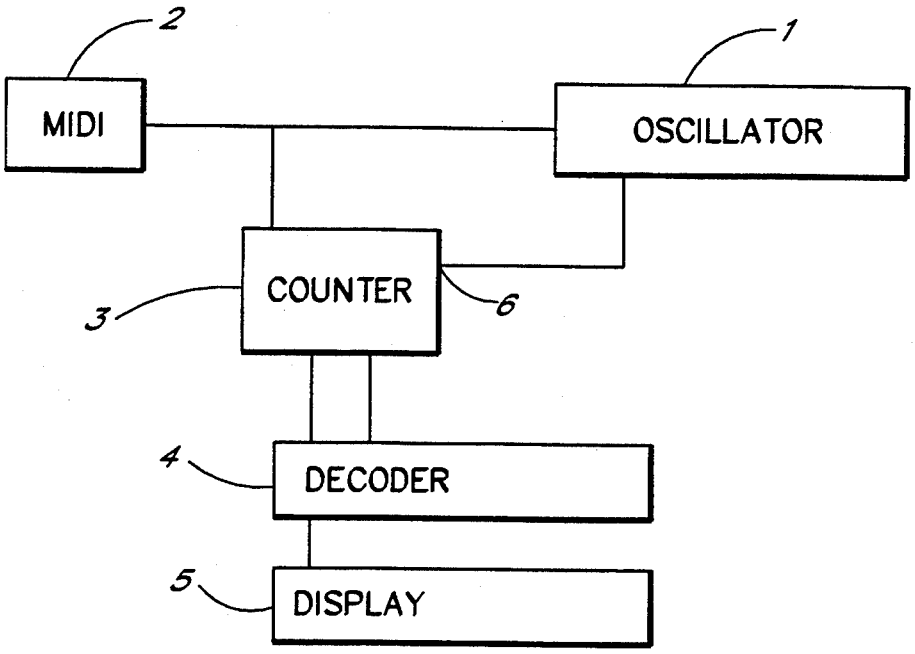
FIG. 1 is a schematic representation of a metronomic apparatus in accordance with the first aspect of the present invention.

Referring now to FIG. 1, which is a schematic view of an embodiment of the invention, an oscillator 1 is shown which is reset by the input from MIDI interface 2. The oscillator provides the clock input for an up/-down decade counter 3 such as the CMOS 4029. The decade counter 3 provides an output to decoder/driver 4 which in turn drives multi-segment display 5.

Figure 2:
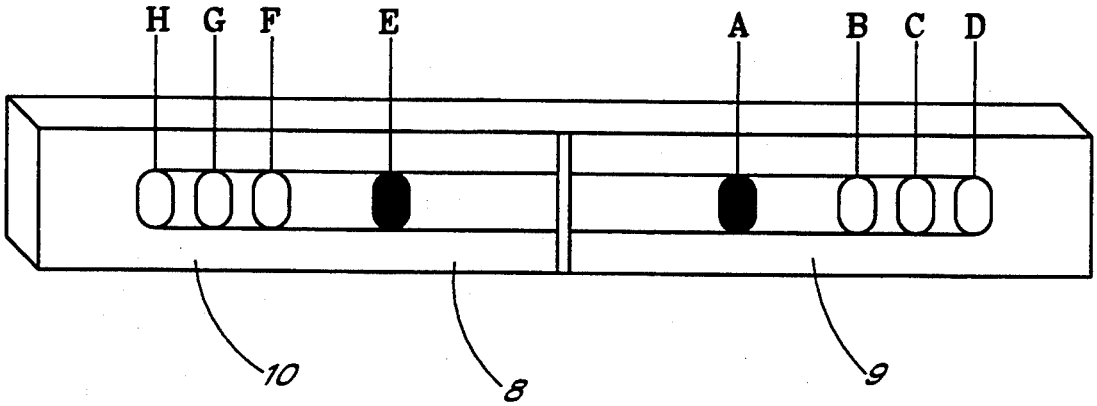
FIG. 2 is a view of such an apparatus showing the arrangement of the lights of the visual display means in such a metronomic apparatus.

Turning to FIG. 2, which is a view of an embodiment of the invention, there is shown the casing 8 of the apparatus, the casing being formed of two limbs 9 & 10 each being thin, flat box like members. The right hand limb 9 incorporates beat light A, which flashes on solely on alternate beats, and a series of between beat lights B, C, and D. The left hand limb incorporates beat light E, which flashes on at the beats which light A misses, and a further series of between beat lights F, G and H.

The operation of the embodiment will now be described, with reference to each of the FIGS. 1 and 2. When the MIDI interface provides a beat timing signal, the oscillator 1 is reset and counter 3 provides a signal to decoder/driver 4 which results in light A of limb 9 flashing on for a brief predetermined time. Meanwhile, the counter 3 is counting the clocking signals input at 6 from the oscillator 1. At a predetermined number of counts, the counter outputs a signal to decoder/driver 4 which results in light B flashing for a brief time. The counter 3 constitutes therefore a timing means which can provide the required between beat timing signals. After a further period in which the same predetermined number of counts is made by counter 3, light C flashes on and so on for light D. The next light to flash on again is then light C, followed by light B. The musician therefore sees a ripple of lights originating at beat light A on the beat and moving up the limb to be reflected at the end of the limb, then to move back down the limb towards beat light A. The next event is the receipt from the MIDI interface of the next beat timing signal. This causes beat light E to flash on and for between beat lights F G and H to subsequently and sequentially flash on in the order F G H G F, mirroring the action of the opposite limb.

The musician using the apparatus is able to control the timing means, i.e. the counter 3, by changing the number of clocking signals the counter must count before it issues the signal which results in each between beat light flashing on. In this way, the musician is able to arrange for the between beat lights to flash on at exactly the right times to guide him or her in playing with the required degree of retardation or advance with respect to the beat. Generally, the musician will take his cue from the outermost light, i.e. D and H, and will gradually alter the counter settings of counter 3 until the outer most lights flash on at the right moment within any beat. The other lights will therefore be used to facilitate him or her anticipating when the outermost lights will flash.

If, when the beat speeds up, all the between beat lights light up in sequence as described above, a confusing and ambiguous display may be presented to the musician since he or she is unable to anticipate clearly when the light from which he or she is taking the cue is going to come on. To mitigate against this, the counter 3 may be arranged not to trigger some of the between beat lights when the beat period is less than a predetermined value. For instance, the sequence of lights could be A B C D followed by E F G H, i.e. none of the between beat lights flash on twice during the period commenced by a given beat.

As an illustration of the use of the apparatus when the full sequence of lights, i.e.

A B C D C B E F G H G F A . . .

is used, should the musician want to play behind the beat then he or she could be taking the cue from the flash of the first B and the first F. Conversely, playing in front of the beat could be achieved by taking the cue from the second B and the second F.

It will be appreciated that the musician may control the timing means so that any particular pair of lights on each limb flashes on at the required moment offset from the beat.

It will also be appreciated that there are a number of arrangements of lights as well as sequences of illumination that may be used.

Figure 3:
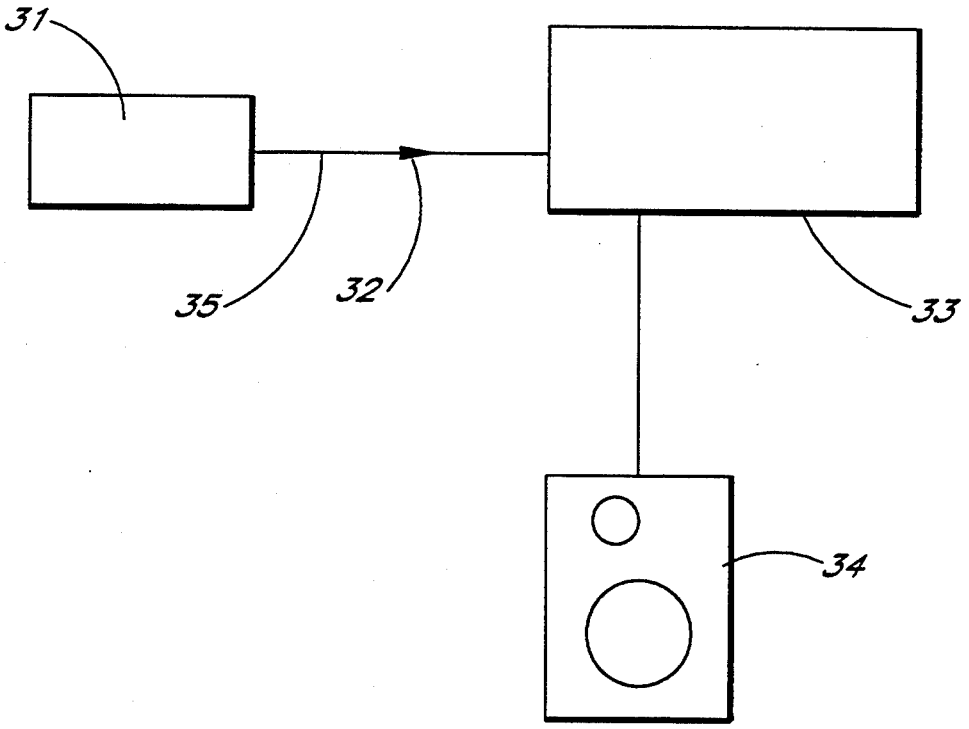
FIG. 3 is a schematic view of a MIDI sequencer controller in accordance with the second aspect of the invention.

Referring to FIG. 3, a foot pedal type input control device 31 is shown connected via cable 35 to MIDI sequencer 33. MIDI sequencer 33 drives MIDI musical instrument 34. The detailed operation of MIDI sequencers is well known in the art and will not be reviewed here.

In a performance, the MIDI sequencer 33 will be playing the programmed sequence, causing the MIDI musical instrument 34 to generate sounds, for instance that of a synthesiser. Should the musicians that are being accompanied by the sequence move out of synchronisation with the sequence, then one of them can operate the foot pedal 31 to nudge the sequence up to the correct synchronisation. Often, the person operating the foot pedal 31 will choose to do so only when the sequencer is not generating any changing music, for instance when the MIDI instrument 34 is silent. It is at precisely such times that the the musicians are most likely to get out of synchronisation with the sequence. In many bands, it is the drummer who determines the tempo at which the music is played and it is he who would operate the foot pedal 1. When he does so, an output signal 32 is generated by an output signal generator (not shown) within the foot pedal 31. The output signal 32 controls the sequencer by causing the MIDI clock to advance or retard a predetermined number of MIDI clock cycles. This may be achieved by an increase in the tempo for a short period. Since the sequencer circuitry or software is well known in this art and various methods of implementing this control function would be within the routine knowledge of those working in this art, a particular approach will not be detailed here.

Generally, the clock cycle will be edged forward one or two cycles, entirely skipping the intervening portions of recorded information. In the FIG. 3 embodiment, a single tap on the pedal of the foot pedal 31 causes the MIDI clock to advance 1 cycle. A longer depression of the pedal causes the MIDI clock to advance 2 cycles. A further foot pedal (not shown) can be connected to the sequencer 33 which when triggered causes the MIDI cycle to retard 1 or 2 cycles, as opposed to advance as in foot pedal 31.

I claim:

1. Metronomic apparatus to assist a musician to play in accompaniment to music of a given beat comprising:

means for providing a given beat signal indicative of the given beat of the music;

timing means providing a beat timing signal arranged to occur a selectable predetermined time in advance of or behind the given beat signal; and visual display means providing a display in dependence upon the beat timing signal.

2. Metronomic apparatus as claimed in claim 1 in which the visual display means comprises two limbs, each limb comprising a beat light and a series of between beat lights, the lights on one limb being sequentially triggered during a first beat timing period and the lights on the other limb being triggered during a second beat timing period following the first beat timing period.

3. Metronomic apparatus as claimed in claim 2 in which the lights are arranged on each limb so that an apparent movement of light between the lights has a simple harmonic form.

4. Metronomic apparatus as claimed in claim 1 in which the given beat signal is a MIDI signal.

5. Metronomic apparatus as claimed in claim 1 wherein the timing means are controllable by the musician to allow the degree which the timing beat signals are in advance of or behind the given beat signals to be set precisely.

6. Metronomic apparatus as claimed in claim 1 wherein the degree which the beat timing signals are in advance of or behind the given beat signals is determined by a tempo of the given beat.

7. A metronomic apparatus to assist a musician to play in accompaniment to music of a given beat comprising:

a signal generator which provides a given beat signal indicative of the given beat of the music;

a counter which provides a beat timing signal at a selectable predetermined time in advance of or behind the given beat signal;

an input control device which enables the musician to control the predetermined time at which the beat timing signal occurs with respect to the given beat signal; and a display which provides a visual representation of the beat timing signal.

8. The metronomic apparatus of claim 7, wherein the display comprises first and second limbs, each limb comprising a beat light and a series of between beat lights, the lights on the first limb being sequentially triggered during a first beat timing period and the lights on the second limb being triggered during a second beat timing period following the first beat timing period.

9. The metronomic apparatus of claim 8, wherein the lights are arranged on each limb such that the apparent movement of the lights during the sequentially triggering has a simple harmonic form.

10. The metronomic apparatus of claim 7, wherein the signal generator comprises a MIDI sequencer.

11. The metronomic apparatus of claim 7, wherein the time at which the beat timing signals are in advance of or behind the given beat signals is determined by a tempo of the given beat.

* * * * *